US007090463B2

(12) United States Patent
Milburn et al.

(10) Patent No.: US 7,090,463 B2
(45) Date of Patent: Aug. 15, 2006

(54) GUIDE VANE

(75) Inventors: Richard G Milburn, Nottingham (GB); Alison J McMillan, Uttoxeter (GB)

(73) Assignee: Rolls-Royce plc, London (GB)

( * ) Notice: Subject to any disclaimer, the term of this patent is extended or adjusted under 35 U.S.C. 154(b) by 79 days.

(21) Appl. No.: 10/866,827

(22) Filed: Jun. 15, 2004

(65) Prior Publication Data

US 2005/0042083 A1 Feb. 24, 2005

(30) Foreign Application Priority Data

Jul. 9, 2003 (GB) ..... 0315975.3

(51) Int. Cl.
*F01D 1/02* (2006.01)

(52) U.S. Cl. ..... 415/211.2

(58) Field of Classification Search ..... 415/191, 415/211.2

See application file for complete search history.

(56) References Cited

U.S. PATENT DOCUMENTS 5,479,705 A * 1/1996 Fowler et al. ..... 29/889.72
6,467,168 B1 * 10/2002 Wallis ..... 29/889.721
6,866,479 B1 * 3/2005 Ishizaka et al. ..... 415/209.1

FOREIGN PATENT DOCUMENTS

| | | |
|---|---|---|
| GB | 2 147 055 A | 5/1985 |
| GB | 2 306 353 A | 5/1997 |
| GB | 1 092 485 A | 7/2003 |

* cited by examiner

*Primary Examiner*—Ninh H. Nguyen
(74) *Attorney, Agent, or Firm*—W. Warren Taltavull; Manelli Denison & Selter PLLC

(57) ABSTRACT

A guide vane 100 is provided in which sheet portions 14, 15 are secured together to define an aerofoil profile 11. Between ends 20, 21 of the guide vane 100 there is a non linear variation in the maximum chordal thickness 13. Thus, greater maximum chordal thickness 13*b* in central portions of the guide vane 100 provide stiffness while ends 20, 21 which are generally formed from solid material have a smaller maximum chordal thickness such that a stiffer vane 100 can be provided with reduced material weight and therefore costs.

16 Claims, 5 Drawing Sheets

GUIDE VANE

FIELD OF THE INVENTION

The present invention relates to guide vanes and more particularly to outlet guide vanes used in gas turbine engines.

BACKGROUND OF THE INVENTION

Referring to FIG. 9, a gas turbine engine is generally indicated at 110 and comprises, in axial flow series, an air intake 111, a propulsive fan 112, an intermediate pressure compressor 113, a high pressure compressor 114, combustion equipment 115, a high pressure turbine 16, an intermediate pressure turbine 117, a low pressure turbine 118 and an exhaust nozzle 119.

The gas turbine engine 110 works in a conventional manner so that air entering the intake 111 is accelerated by the fan 112 which produce two air flows: a first air flow into the intermediate pressure compressor 113 and a second air flow which provides propulsive thrust. The intermediate pressure compressor 113 compresses the air flow directed into it before delivering that air to the high pressure compressor 114 where further compression takes place.

The compressed air exhausted from the high pressure compressor 114 is directed into the combustion equipment 115 where it is mixed with fuel and the mixture combusted. The resultant hot combustion products then expand through, and thereby drive, the high, intermediate and low pressure turbines 116, 117 and 118 respectively before being exhausted through the exhaust nozzle 119 to provide additional propulsive thrust. The high, intermediate and low pressure turbine 116, 117 and 118 respectively drive the high and intermediate pressure compressors 114 and 113, and the fan 112 by suitable interconnecting shafts.

Low pressure fan outlet guide vanes (OGVs) 100 are located behind the propulsive fan 112 in a bypass duct 101 of the gas turbine engine 110. The fan outlet guide vanes 100 have two functions. An aerofoil profile of the fan outlet guide vane 100 straightens air flow through the bypass duct 101 to improve engine efficiency and therefore fuel consumption. The fan outlet guide vanes 100 also act as structural components in order to transmit engine loads to the nacelle and casing of the gas turbine engine 110 and so support that nacelle structure upon the core of the gas turbine engine 110.

Typically, fan outlet guide vanes 100 are manufactured from sheet material for example a titanium alloy such as Ti 6A1 4V. The main structural factor is flutter margin which in turn is related to aerofoil curvature and its maximum chordal thickness.

Previously, fan outlet guide vanes 100 have been manufactured in accordance with a method whereby two plates or a folded plate of material are diffusion bonded along respective abutting edges and then superplastically deformed by inflation to create a hollow structure. In such circumstances, maximum chordal thickness varies in a linear progression along the length of the fan outlet guide vane structure. It will be understood that the diffusion bonded edge portions are relatively stable and not inflated whilst the central sections of the vanes are machined to allow the thin inflation process to form the hollow structure. In such circumstances utilising sheet to sheet flat materials necessitates use of thicker materials at the edges than necessary in order to ensure there is adequate material in the central sections to provide the linear progression in thickness for structural strength. Such additional material adds to weight as well as cost.

In accordance with the present invention there is provided a guide vane for a gas turbine engine, the guide vane comprising a first end, a second end, a first longitudinal edge, a second longitudinal edge and sheet portions, the sheet portions being bonded along the first and second longitudinal edges, the sheet portions being deformed to form a cavity therebetween, the deformed sheet portions defining a non linear variation in maximum chordal thickness along the guide vane between the first end of the guide vane and the second end of the guide vane.

Preferably each sheet portion being convex outwardly between the first and second ends of the guide vane.

SUMMARY OF THE INVENTION

Also in accordance with the present invention there is provided a method of forming a guide vane for a gas turbine engine comprising forming sheet portions, bonding longitudinal edges of the sheet portions and deforming the sheet portions between those longitudinal edges to define the guide vane with a non-linear variation in maximum chordal thickness along the guide vane from a first end to a second end of the guide vane.

Preferably, the longitudinal edges are bonded by diffusion bonding.

Generally, the sheet portions are formed from a material such as Ti 6A1 4V.

Generally, the longitudinal edges of the sheet portions are bulbous when bonded together until formed as part of a guide vane.

Generally, the sheet portions have a flat side prior to deformation on an opposite side of the sheet portion from a convexed side.

BRIEF DESCRIPTION OF THE DRAWINGS

An embodiment of the present invention will now be described by way of example only and with reference to the accompanying drawings in which.

DETAILED DESCRIPTION OF THE INVENTION

Figure 1:
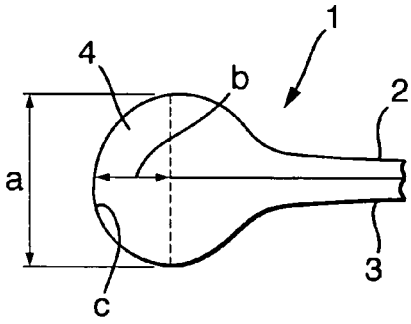
FIG. 1 is a schematic cross section of a longitudinal edge of a guide vane in accordance with the present invention prior to deformation.
Figure 2:
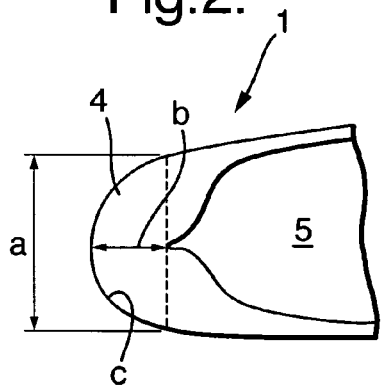
FIG. 2 is a schematic cross section of a longitudinal edge of a guide vane in accordance with the present invention after deformation.

FIGS. 1 and 2 illustrate a longitudinal edge 1, in this case the leading edge, of a fan outlet guide vane 100. FIG. 1 illustrates that longitudinal edge 1 prior to deformation by inflation and FIG. 2 shows that edge 1 after deformation. The cross section is shown at an intermediate position within a fan outlet guide vane cavity 5 when formed by inflated deformation. Generally, two sheet portions, 2, 3 are placed in a juxtaposed position and bonded along an edge zone 4. The portions 2, 3 may be formed by overlapping juxtaposed sheets or folding over a single sheet. This bonding is typically by a diffusion bonding process such that there is a diffusion bond width "b". The minimum diffusion bond width "b" is defined by the necessary structural integrity requirements for the fan outlet guide vane 100 which in turn are dependent upon the structural loading presented to the fan outlet guide vane eventually formed in supporting a casing upon an engine core. A leading edge profile "c" as indicated previously is substantially stable subsequent to the diffusion bonding process and therefore substantially defines the eventual edge profile and so must be formed with respect to necessary aerodynamic considerations for the fan outlet guide vane 100. The edge zone 4 has a minimum thickness "a" which is dictated by the necessary requirements for the diffusion bond thickness "b" as well as formation of the aerodynamic profile "c". As indicated previously the thickness "a" should be kept to a minimum in order to reduce material weight for operational purposes with regard to a gas turbine engine 110 incorporating the fan outlet guide vane 100 as well as with respect to cost.

Figure 3:
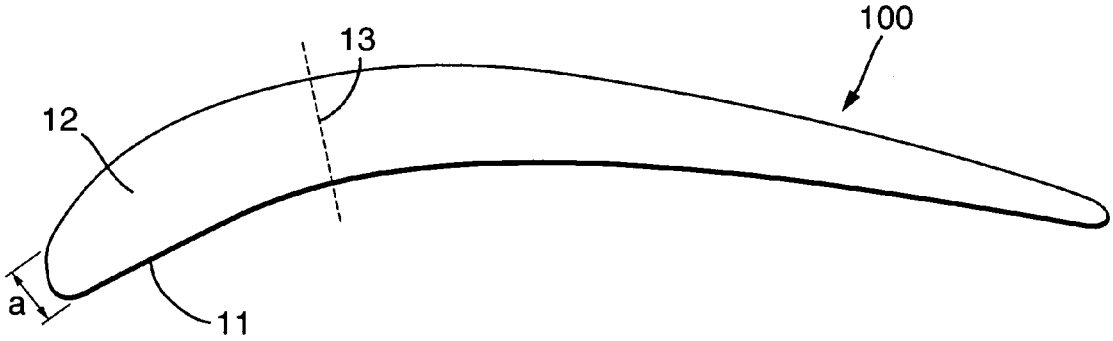
FIG. 3 is a schematic plan end view of one end of a guide vane in accordance with the present invention.

FIG. 3 is a schematic plan view of a fan outlet guide vane 100 in accordance with the present invention. Thus, an aerofoil profile 11 of the fan outlet guide vane 100 is depicted. Ends of the fan outlet guide vane 100 are solid and as can be seen an end 12 defines the aerofoil profile 11 with a maximum chordal thickness 13 shown as the actual spaced thickness of the plates 2, 3 secured together as the deformation cavity. This chordal thickness 13 is considerably greater than the minimum thickness "a" defined in accordance with the description given with regard to thickness a in FIG. 1. In such circumstances, when inflated in order to provide by deformation a cavity 5 (FIG. 2), a fan outlet guide vane 100 is formed by divergence of the plates 2, 3 to create the cavity 5 and therefore aerofoil profile 11 (FIG. 3). The end 12 nevertheless as indicated is much thicker than the minimum thickness "a" for unnecessary reasons and so adds significantly to weight and cost.

Previous linear progression in sheet thickness from one end of the fan outlet guide vane 100 to the other that is to say perpendicularly to the plane of FIGS. 1, 2, 3 causes the requirement to have greater material thickness at ends 12 than necessary. It will be understood that it is the ends 12 at each end of the fan outlet guide vane 100 which are secured to provide structural strength within a gas turbine engine 110. In such circumstances to increase stiffness of the fan outlet guide vane 100 it is necessary to increase the overall thickness of the fan outlet guide vane 100 which in turn adds to weight and cost.

Figure 4:
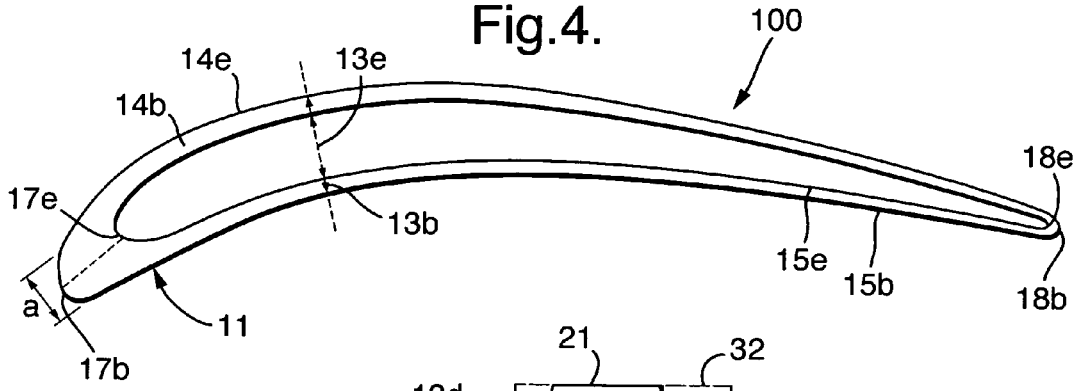
FIG. 4 is a schematic plan view of one end and an intermediate position of a guide vane in accordance with the present invention; and, FIG. 5 is a schematic cross-section of the maximum chordal thickness at different positions of a guide vane in accordance with the present invention.

FIG. 4 illustrates plan views of the fan outlet guide vane 100 at one end and at an intermediate position. Thus, the fan outlet guide vane 100 again defines the aerofoil vane profile 11 in which a convex suction surface 14 is spaced from a concave suction surface 15 and the convex suction surface 14 and the concave pressure surface 15 extend from a leading edge 17 to a trailing edge 18. The maximum chordal thickness 13 is defined between the convex suction surface 14 and the concave pressure surface 15 and varies along the length of the fan outlet guide vane 100. Typically the fan outlet guide vane 100 is formed from two sheets of material bonded along the leading edge and trailing edges 17, 18 or a single sheet of material bent about trailing edge 18 and bonded typically by diffusion bonding at the other edge 17. A cavity is created by inflative deformation in order to create the aerofoil profile 11. The aerofoil vane profile at the inner foot has a leading edge 17*e*, a trailing edge 18*e*, a convex suction surface 14*e*, a concave pressure surface 15*e* and a maximum chordal thickness 13*e*. The aerofoil vane profile at the intermediate position has a leading edge 17*b*, a trailing edge 18*b*, a concave suction surface 14*b*, a concave pressure surface 15*b* and a maximum chordal thickness 13*b*.

In accordance with the present invention the maximum chordal thickness 13 varies along the length of the fan outlet guide vane 100. Thus one end typically defined as the inner foot has one maximum chordal thickness 13*e* and then the fan outlet guide vane 100 generally increases to a greater maximum chordal thickness 13*b* at the intermediate position between that inner foot end and an outer foot end at the other end of the fan outlet guide vane 100. The maximum chordal thickness then decreases to a maximum chordal thickness 13*d* at the outer foot end at the other end of the fan outlet guide vane 100.

Figure 5:
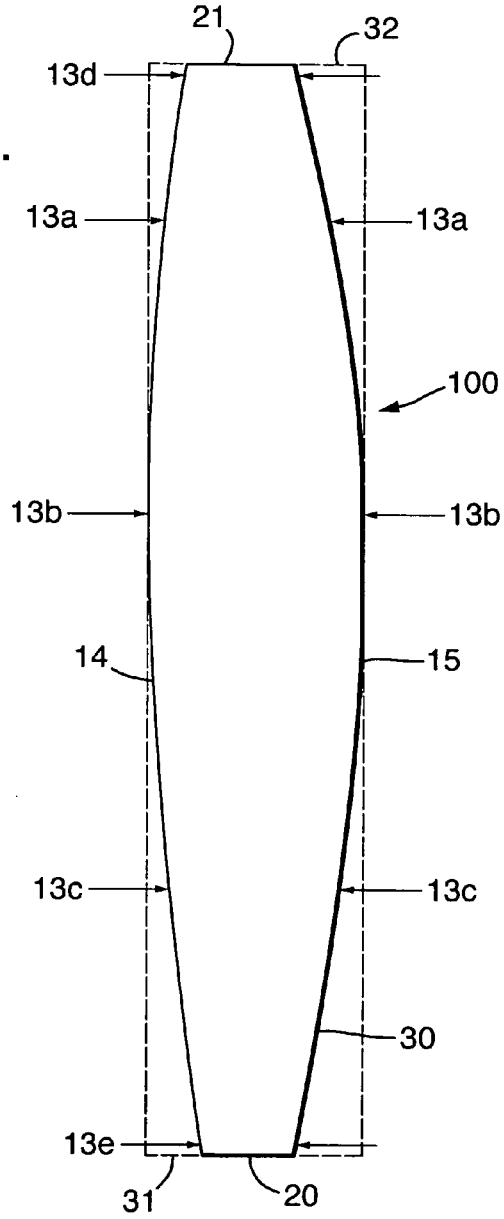

FIG. 5 illustrates the maximum chordal thickness at different positions between the inner and outer ends of the fan outlet vane 100. As can be seen there is a non linear progression of the maximum chordal thickness 13 between the first inner foot end 20 and the other outer foot end 21. Generally, the surfaces 14, 15 diverge in a bi convexed relationship such that outer maximum chordal thicknesses 13*a*, 13*c* are narrower than central maximum chordal thicknesses 13*b*. In such circumstances, the fan outlet guide vane 100 is rendered stiffer but the outer ends 20, 21 are narrower and therefore require less material with improvements both in weight and cost for the fan outlet guide vane 100.

A broken line illustrates schematically the front profile of a previous guide vane. Thus, it can be seen that the ends 31, 32 will generally be of substantially the same width as the central chordal thickness 13*b*. In such circumstances, as indicated previously, as these ends 31, 32 are made from solid material it will be understood that there is significant material weight as well as costs associated with providing linear progression in chordal thickness 13 from end 31 to end 32 of a prior vane with a profile 30.

In the above circumstances the minimum material thickness defined in juxtaposed plates as described previously with respect to FIGS. 1 and 2 can be utilised without compromising chordal guide vane thickness 13. It will be recalled that the minimum material thickness "a" is in principal defined by the necessary leading edge profile ("c" in FIGS. 1 and 2) as well as the necessary bond width ("b" in FIGS. 1 and 2). Typically the sheet material from which the guide vane 10 is formed is Ti 6AI 4V to allow appropriate inflative deformation to create the guide vane aerofoil profile 11.

In order to form a guide vane in accordance with the present invention typically a guide vane profile is provided in which respective sheets or a sheet of material is configured with juxtaposed sheet portions bonded along a longitudinal edge to allow inflation deformation of the pocket cavity between the sheets or folded sheet portions in order to define the cavity for aerofoil vane profile 11. This profile 11 presents a varying chordal thickness 13 between one end of the fan outlet guide vane 100 and the other end in order to create the divergent surfaces 14, 15 whilst ends 20, 21 which provide the foot mountings for the fan outlet guide vane for structural support within a gas turbine engine. These ends 20, 21 are narrower than the chordal thickness 13 between the ends 20, 21. Thus, there is a non linear variation in the chordal thickness 13 between the ends 20, 21. The greater chordal thickness at central portions of the fan outlet guide vane 100 provides greater stiffness whilst the solid material ends 20, 21 are narrower and so require less material with consequential reductions in material weight and cost for the fan outlet guide vane 100.

A guide vane in accordance with the present invention is formed by presenting sheets of material either as separate sheets in juxtaposed positions with respective longitudinal edges bonded together or by folding a single sheet of material to form a pocket within which by inflative deformation a cavity 16 is formed to create a profile 11. The material thickness which defines the thickness "a" is reduced from that conventionally utilised as the greater central chordal thickness 13*b* achieves stiffness without material thickness. Thus the ends 20, 21 which by necessity are formed from solid material are narrower and therefore require less material with resultant produced overall material weight for the vane 10.

Figure 6:
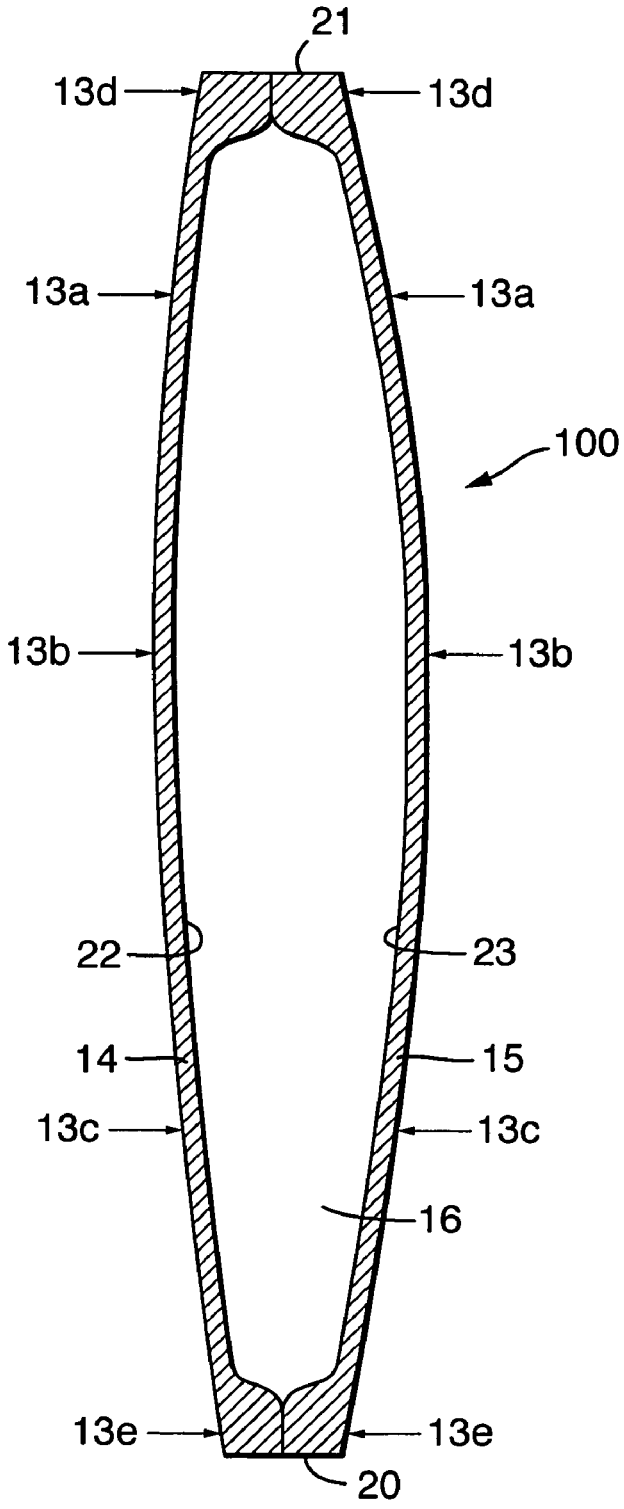
FIG. 6 is a cross-section of the maximum chordal thickness at different positions of the guide vane shown in FIG. 5.

The cavity 16 formed by inflative deformation is shown clearly in FIG. 6 and it is seen that the cavity increases in width from the end 20 to a central maximum width and then decreases from the central maximum to the end 21 to produce the outer maximum chordal thickness 13*d*, 13*e* which are narrower than the central maximum thicknesses 13*b*. It is to be noted that the thicknesses of the convex wall 22 and the concave wall 23, which define the convex suction surface 14 and the concave pressure surface 15 respectively, have substantially the same thickness, a uniform thickness, throughout the regions defining the cavity 16.

Figure 7:
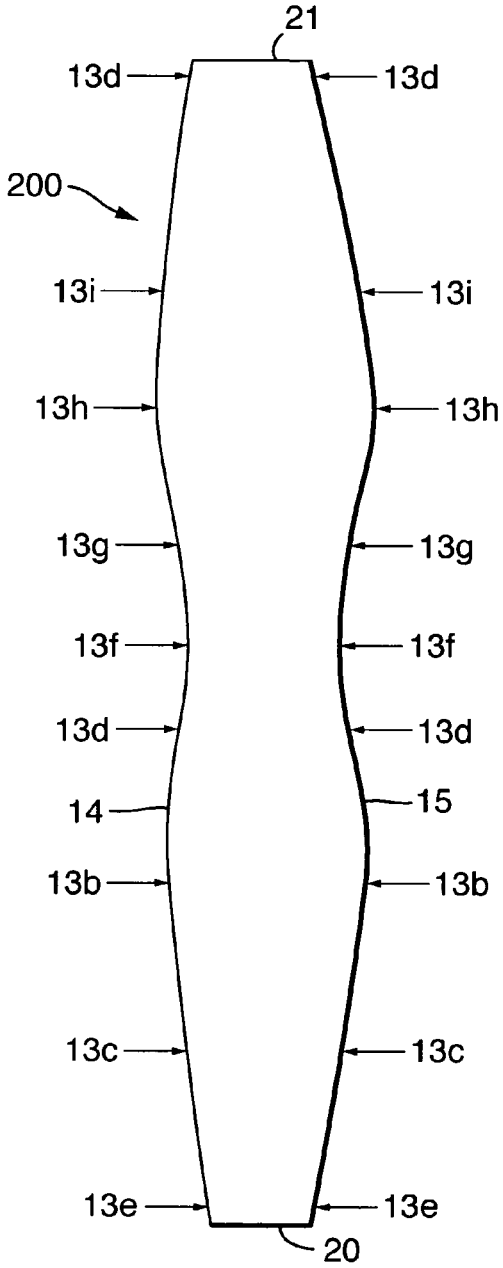
FIG. 7 is a schematic cross-section of the maximum chordal thickness at different positions of a further guide vane in accordance with the present invention.
Figure 8:
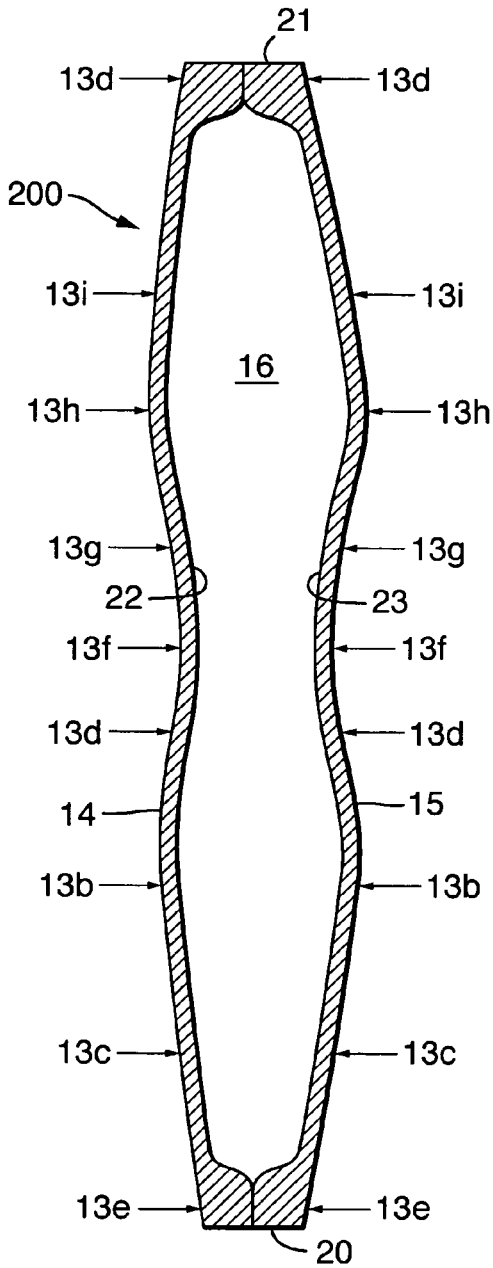
FIG. 8 is a cross-section of the maximum chordal thickness at different positions of the guide vane shown in FIG. 7.
Figure 9:
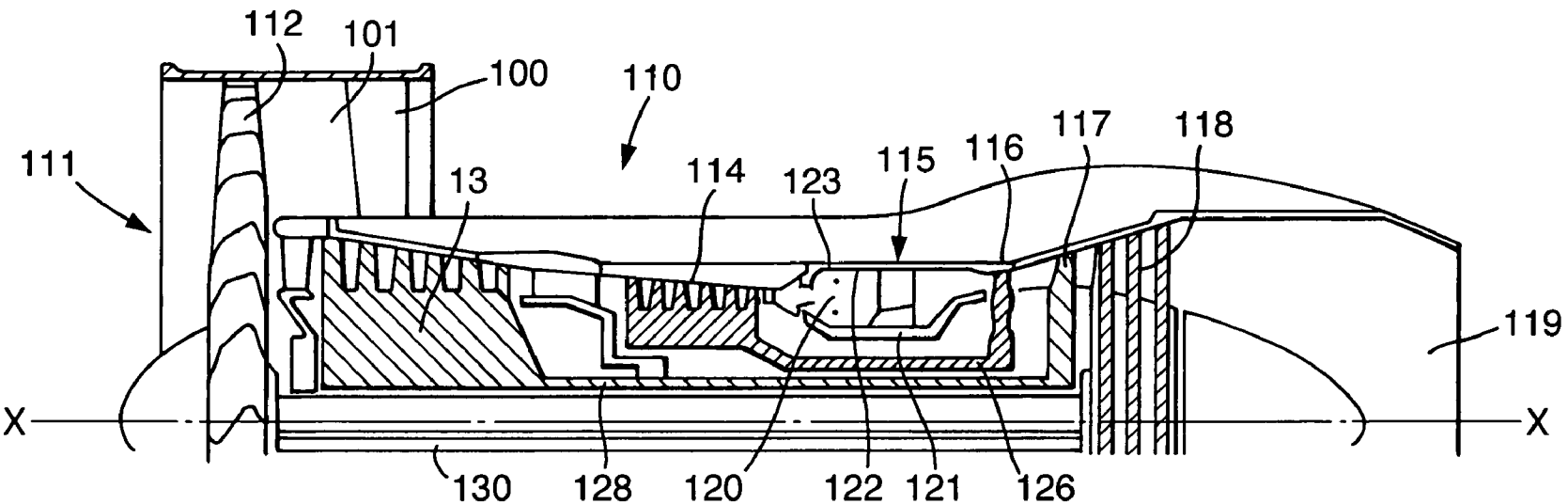
FIG. 9 is a cross-sectional view of a gas turbine engine.

A further fan outlet guide vane 200 is shown in FIGS. 7 and 8 has a maximum chordal thickness which varies along the length of the fan outlet guide vane 200.

Thus the inner foot end 20 has a maximum chordal thickness 13*e*, then the fan outlet guide vane 200 increases to a maximum chordal thickness 13*b* at a position between the inner foot end 20 and the outer foot end 21.

The maximum chordal thickness then decreases to a maximum chordal thickness 13*f* at the central maximum chordal thickness, approximately midway between the inner foot end 20 and the outer foot end 21. The maximum chordal thickness then increases to a maximum to a maximum chordal thickness 13*h* at a position between the inner foot end 20 and the outer foot end 21 and then the maximum chordal thickness decreases to a maximum chordal thickness 13*d* at the outer foot end 21. Thus, it is seen that the surfaces 14 and 15 diverge, converge, diverge and then converge from the inner foot end 20 to the outer foot end 21, such that the outer maximum chordal thickness 13*d* and 13*e* and the central maximum chordal thickness 13*f* are narrower than the maximum chordal thicknesses 13*b* and 13*h*. Again the fan outlet guide vane 200 is rendered stiffer, but the outer ends 20,21 are narrower and therefore require less material with improvements both in weight and cost for the fan outlet guide vane 200.

The cavity 16 formed by inflative deformation is shown in FIG. 8 and it is seen that the cavity increases in width from the end 20 to a maximum width and then decreases from the maximum width to the central maximum chordal thickness 13*f*. The cavity then increases width from the central maximum chordal thickness 13*f* to a maximum width and then decreases from the maximum width to the end 21 to produce the outer maximum chordal thicknesses 13*d*, 13*e* and central maximum chordal thickness 13*f* which are narrower than the maximum chordal thickness 13*b* and 13*h*. It is again to be noted that the thicknesses of the convex wall 22 and the concave wall 23, which define the convex suction surface 14 and the concave pressure surface 15 respectively, have substantially the same thickness through the regions defining the cavity 16.

Thus in this embodiment the surfaces 14 and 15 in going from the first end 20 to the second end 21 alternately convex at a first position, concave at a third position and then convex at a second position.

Although the present invention has been described with reference to fan outlet guide vanes, the present invention is equally applicable to other guide vanes, for example compressor guide vanes, turbine guide vane, in particular the guide vanes in the compressor intercase and the guide vanes in the turbine tail bearing housing. The guide vanes in the compressor intercase and/or tail bearing housing extend and also act as structural components to support bearings and to transmit loads to the nacelle and casing.

Additionally the guide vane may be provided with a vibration damping material within the cavity to reduce vibrations of the guide vane. Alternatively a corrugated core member may be diffusion bonded to the convex wall and concave wall to reduce vibrations of the guide vane, the core member is preferably diffusion bonded and formed by inflative deformation as the same time as the convex wall and concave wall. It may be desirable to provide local thickening ribs to alter the stiffness of the guide vane, these ribs may extend radially, chordally or radially and chordally. These ribs are arranged on the inner surface of the guide vane, but are initially machined on the outer surface of the sheet portions used to fan the guide vane.

The exact position of the maximum chordal thicknesses 13*b* in FIG. 6 or maximum chordal thicknesses 13*b* and 13*h* in FIG. 8 are selected for maximum stiffness or a combination of enhanced stiffness without detriment to aerodynamics flow.

It may be possible to have three or more maximum maximum chordal thicknesses and four or more minimum maximum chordal thicknesses.

It is to be noted that the sheet portions are bonded along their ends as well as along their longitudinal edges, typically by diffusion bonding in all embodiments of the present invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A guide vane for a gas turbine engine, the guide vane comprising a first end, a second end, a first longitudinal edge, a second longitudinal edge and sheet portions being bonded along the first and second longitudinal edges, the sheet portions being deformed to form a cavity therebetween, the deformed sheet portions defining a non linear variation in maximum chordal thickness along the guide vane between the first end and the second end of the guide vane wherein each sheet portion being convex outwardly between the first end and the second end of the guide vane wherein the maximum chordal thickness increasing from the first end to a greater maximum chordal thickness at a central portion of the guide vane between a first end and a second end, the maximum chordal thickness decreasing from the central portion to the second end, the cavity increasing in width from the first end to a maximum width at the central portion and the cavity decreasing in width from the maximum width at the central portion to the second end.

2. A guide vane as claimed in claim 1 wherein the sheet portions are bonded along the first and second longitudinal edges by diffusion bonding.

3. A guide vane as claimed in claim 1 wherein the sheet portions are bonded along the first and second ends.

4. A guide vane as claimed in claim 3 wherein the sheet portions are bonded along the first and second ends by diffusion bonding.

5. A guide vane as claimed in claim 1 wherein the guide vane is a fan outlet guide vane.

6. A guide vane as claimed in claim 1 wherein each sheet portion being convex outwardly at first and second positions between the first end and the second end of the guide vane, and each sheet portion being concave inwardly at a third position between first and the second positions which are convex outwardly.

7. A guide vane as claimed in claim 6 wherein the third position being at the central position of the guide vane.

8. A guide vane as claimed in claim 6 wherein the cavity increases in width from the first end of the guide vane to maximum width at the first position, the cavity decreases in width from the maximum width at the first position to a minimum width at the third position, the cavity increases in width from the minimum width at the third position to a maximum width at the second position and the cavity decreases in width from the maximum width at the second position to the second end of the guide vane.

9. A guide vane as claimed in claim 6 wherein the thickness of the regions of the sheet portions defining the cavity have a uniform thickness.

10. A guide vane as claimed in claim 1 wherein the thickness of the regions of sheet portions defining the cavity have a uniform thickness.

11. A guide vane for a gas turbine engine, the guide vane comprising a first end, a second end, a first longitudinal edge, a second longitudinal edge, a concave pressure wall extending from the first longitudinal edge to the second longitudinal edge, a convex suction wall extending from the first longitudinal edge to the second longitudinal edge, the convex suction wall being convex between the first end and the second end and the concave pressure wall being convex between the first end and the second end to define a non linear variation in maximum chordal thickness along the guide vane between the first end and the second end of the guide vane, the guide vane having a cavity, the cavity increasing in width from the first end to a maximum width and the cavity decreasing in width from the maximum width to the second end.

12. A guide vane for a gas turbine engine, the guide vane comprising a first end, a second end, a first longitudinal edge, a second longitudinal edge, a concave pressure wall extending from the first longitudinal edge to the second longitudinal edge, a convex suction wall extending from the first longitudinal edge to the second longitudinal edge, the convex suction wall being convex at a first position between the first end and the second end, the convex suction wall being convex at a second position between the first end and the second end, the convex suction wall being concave at a third position between the first and second positions, the concave pressure wall being convex at a fourth position between the first end and the second end, the concave pressure wall being convex at a fifth position between the first end and the second end, the concave pressure wall being concave at a sixth position between the fourth position and the fifth position to define a non linear variation in maximum chordal thickness along the guide vane between the first end and the second end of the guide vane, the guide vane having a cavity, the cavity increasing in width from the first end to a maximum width, the cavity decreasing in width from the maximum width to a minimum width, the cavity increasing in width from the minimum width to a maximum width and the cavity decreasing in width from the maximum width to the second end.

13. A guide vane for a gas turbine engine, the guide vane comprising a first end, a second end, a first longitudinal edge, a second longitudinal edge and sheet portions being bonded along the first and second longitudinal edges, the sheet portions being deformed to form a cavity therebetween, the deformed sheet portions defining a non linear variation in maximum chordal thickness along the guide vane between the first end and the second end of the guide vane wherein each sheet portion being convex outwardly between the first end and the second end of the guide vane wherein the cavity increases in width from the first end of the guide vane to a maximum width, the cavity decreases in width from the maximum width to the second end of the guide vane.

14. A guide vane for a gas turbine engine, the guide vane comprising a first end, a second end, a first longitudinal edge, a second longitudinal edge and sheet portions being bonded along the first and second longitudinal edges, the sheet portions being deformed to form a cavity therebetween, the deformed sheet portions defining a non linear variation in maximum chordal thickness along the guide vane between the first end and the second end of the guide vane wherein each sheet portion being convex outwardly at first and second positions between the first end and the second end of the guide vane, and each sheet portion being concave inwardly at a third position between first and the second positions which are convex outwardly.

15. A guide vane for a gas turbine engine, the guide vane comprising a first end, a second end, a first longitudinal edge, a second longitudinal edge, a concave pressure wall extending from the first longitudinal edge to the second longitudinal edge, a convex suction wall extending from the first longitudinal edge to the second longitudinal edge, the convex suction wall being convex between the first end and the second end and the concave pressure wall being convex between the first end and the second end to define a non linear variation in maximum chordal thickness along the guide vane between the first end and the second end of the guide vane, the guide vane having a cavity, the maximum chordal thickness increasing from the first end to a greater maximum chordal thickness at a central portion of the guide vane between the first end and the second end and the maximum chordal thickness decreasing from the central portion to the second end, the cavity increasing in width from the first end to a maximum width at the central portion and the cavity decreasing in width from the maximum width at the central portion to the second end.

16. A guide vane for a gas turbine engine, the guide vane comprising a first end, a second end, a first longitudinal edge, a second longitudinal edge, a concave pressure wall extending from the first longitudinal edge to the second longitudinal edge, a convex suction wall extending from the first longitudinal edge to the second longitudinal edge, the maximum chordal thickness increasing from the first end to a maximum chordal thickness at a first position between the first end and the second end, the maximum chordal thickness decreasing from the first position to a third position between the first position and a second position, the maximum chordal thickness increasing from the third position to the second position between the first end and the second end and the maximum chordal thickness decreasing from the second position to the second end such that the convex suction wall being convex at the first position between the first end and the second end, the convex suction wall being convex at the second position between the first end and the second end, the convex suction wall being concave at the third position between the first and second positions, the concave pressure wall being convex at the first position between the first end and the second end, the concave pressure wall being convex at the second position between the first end and the second end, the concave pressure wall being concave at the third position between the first position and the second position to define a non linear variation in maximum chordal thickness along the guide vane between the first end and the second end of the guide vane, the guide vane having a cavity, the cavity increasing in width from the first end to a maximum width at the first position, the cavity decreasing in width from the maximum width at the first position to a minimum width at the third position to a maximum width at the second position and the cavity decreasing in width from the maximum width at the second position to the second end.

* * * * *